US005164781A

United States Patent [19]

Terashima et al.

[11] Patent Number: 5,164,781

[45] Date of Patent: Nov. 17, 1992

[54] COLOR IMAGE ELECTROPHOTOGRAPHIC APPARATUS FOR PRINTING LONG-SIZE COPY IMAGES

[75] Inventors: Isamu Terashima, Hitachi; Syoji Sagae, Hitachioota; Hiroyuki Tadokoro, Hitachi, all of Japan

[73] Assignee: Hitachi, Ltd., Tokyo, Japan

[21] Appl. No.: 735,337

[22] Filed: Jul. 24, 1991

[30] Foreign Application Priority Data

Jul. 25, 1990 [JP] Japan ..... 2-194938
Nov. 30, 1990 [JP] Japan ..... 2-329026

[51] Int. Cl.[5] ..... G03G 15/14; G03G 15/01

[52] U.S. Cl. ..... 355/272; 355/326; 358/450

[58] Field of Search ..... 355/326, 327, 272, 244, 355/46; 358/450, 449, 451

[56] References Cited

U.S. PATENT DOCUMENTS 4,595,273 6/1986 Watanabe et al. ..... 355/244 X
4,615,607 10/1986 Yanagawa et al. ..... 355/326
4,631,596 12/1986 Yaguchi ..... 358/449
4,827,315 5/1989 Wolfberg et al. ..... 346/160
4,924,324 5/1990 Takaoka ..... 358/449 X
4,933,727 6/1990 Mizuma et al. ..... 355/327
4,998,145 3/1991 Haneda et al. ..... 355/327

*Primary Examiner*—A. T. Grimley
*Assistant Examiner*—Nestor R. Ramirez
*Attorney, Agent, or Firm*—Antonelli, Terry, Stout & Kraus

[57] ABSTRACT

Each of color toner images is formed on a photo-sensitive drum using a plural development units. An exposure process and a development process for a color image information are carried out repeatedly corresponding to a respective hue of the image information. The toner images of n colors are transferred to the drum by contacting a recording paper to the drum. A record mode is selected in accordance with a length in a peripheral direction of the drum of the image information against a peripheral length of the drum. When the length of the image information is longer than the peripheral length of the drum, N times transfer processes are selected as the record mode. Then the length of the image information is divided into N areas. The image information of n colors existing in every divided area is formed dividedly on the drum. The color image is recorded on a full length of the paper. Besides, when the length of the image information is shorter than the peripheral length of the drum, one time transfer process is selected as the record mode.

10 Claims, 10 Drawing Sheets

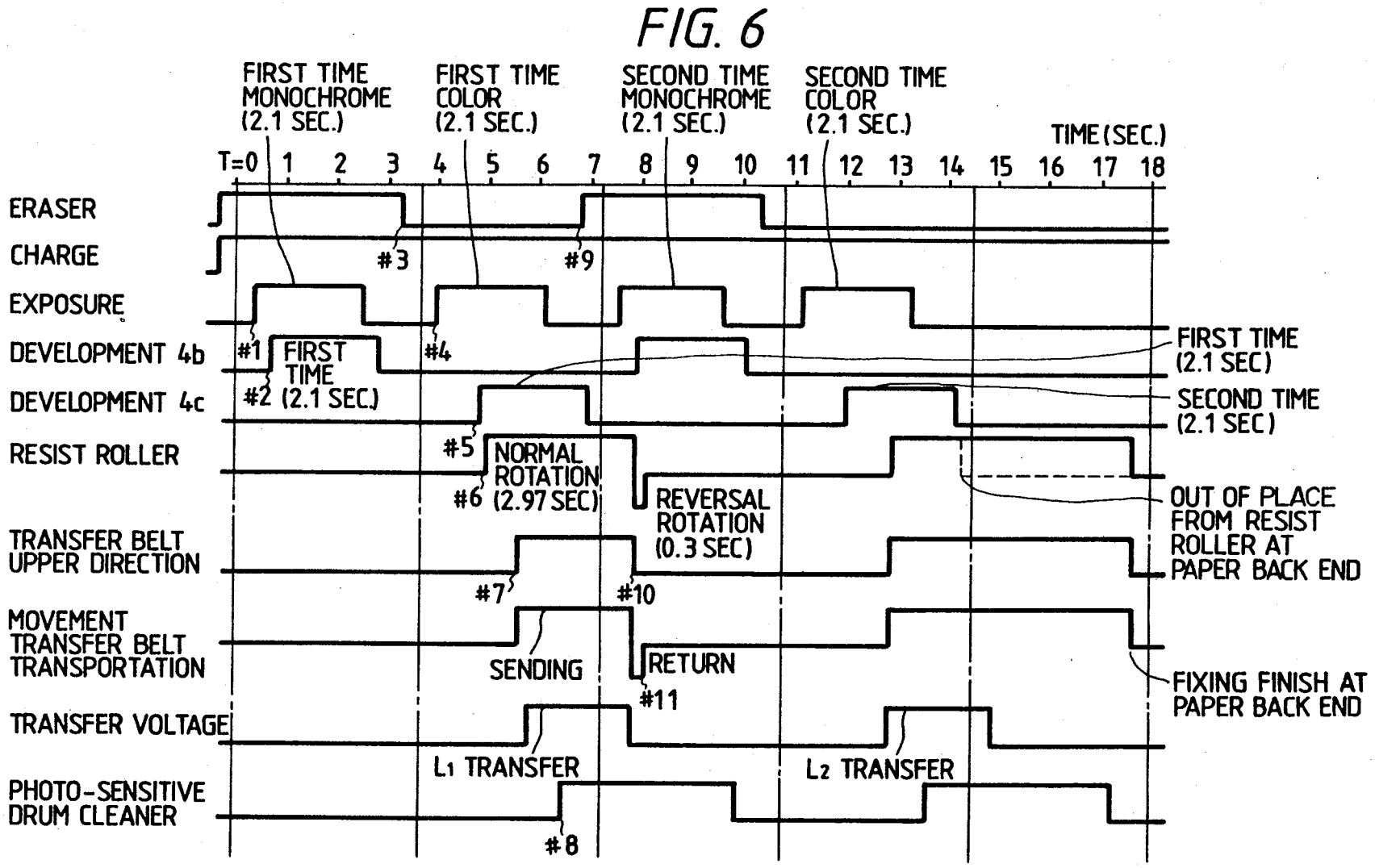
FIG. 6
TIME (SEC.)
T=0
1
2
3
4
5
6
7
8
9
10
11
12
13
14
15
16
17
18
FIRST TIME MONOCHROME (2.1 SEC.)
FIRST TIME COLOR (2.1 SEC.)
SECOND TIME MONOCHROME (2.1 SEC.)
SECOND TIME COLOR (2.1 SEC.)
FIRST TIME (2.1 SEC)
SECOND TIME (2.1 SEC)
OUT OF PLACE FROM RESIST ROLLER AT PAPER BACK END
FIXING FINISH AT PAPER BACK END
ERASER
CHARGE
EXPOSURE
DEVELOPMENT 4b
DEVELOPMENT 4c
RESIST ROLLER
TRANSFER BELT UPPER DIRECTION
MOVEMENT TRANSFER BELT TRANSPORTATION
TRANSFER VOLTAGE
PHOTO-SENSITIVE DRUM CLEANER
#1
#2
FIRST TIME (2.1 SEC.)
#3
#4
#5
NORMAL ROTATION (2.97 SEC)
#6
REVERSAL ROTATION (0.3 SEC)
#7
#10
SENDING
RETURN
#11
L1 TRANSFER
L2 TRANSFER
#8
#9

FIG. 8A

| SYMBOL | IMAGE | IMAGE SIZE | PROCESS EXPLANATION |
|---|---|---|---|
| (a) | A B E<br>C D<br>A B E | A4 SIZE(l0) | ①l0 MONOCHROME IMAGE FORMATION<br>②l0 PART TRANSFER AT A TIME |
| (b) | ア イ<br>ウ エ キ<br>ア イ | A4 SIZE(l0) | ①l0 COLOR IMAGE FORMATION<br>②l0 PART TRANSFER AT A TIME |
| (c) | AアBイE<br>ウCエDキ<br>AアBイE<br>← l0 → | A4 SIZE(l0) | ①FIRST MONOCHROME, NEXT COLOR IMAGE FORMATION<br>②l0 PART TRANSFER AT A TIME |
| (d) | A B ¦ E F<br>C D ¦ G H<br>A B ¦ E F<br>C D ¦ G H | A3 SIZE(L0) | ①L0 MONOCHROME IMAGE FORMATION<br>②L0 PART TRANSFER AT A TIME |
| (e) | ア イ ¦ オ カ<br>ウ エ ¦ キ ク<br>ア イ ¦ オ カ<br>ウ エ ¦ キ ク | A3 SIZE(L0) | ①L0 COLOR IMAGE FORMATION<br>②L0 PART TRANSFER AT A TIME |
| (f) | AアBイ ¦ EオFカ<br>ウCエD ¦ キGクH<br>AアBイ ¦ EオFカ<br>ウCエD ¦ キGクH<br>← L1 → ← L2 →<br>← L0 → | A3 SIZE(L0) | ①FIRST L1 MONOCHROME, NEXT COLOR IMAGE FORMATION<br>②L1 PORTION TRANSFER AT FIRST TIME<br>③FIRST L2 MONOCHROME, NEXT COLOR IMAGE FORMATION<br>④L2 PORTION TRANSFER AT SECOND TIME |

FIG. 8B

| SYMBOL | IMAGE | IMAGE SIZE | PROCESS EXPLANATION |
|---|---|---|---|
| (g) | Aアイ E F<br>ウCエD G H<br>Aアイ E F<br>ウCエD G H | A3 SIZE(L0) | ①FIRST L1 COLOR IMAGE FORMATION<br>②NEXT L1, L2 MONOCHROME IMAGE FORMATION<br>③L0 PART TRANSFER AT A TIME |
| (h) | Aアイ オ カ<br>ウCエD キ ク<br>Aアイ オ カ<br>ウCエD キ ク | A3 SIZE(L0) | ①FIRST L1 MONOCHROME IMAGE FORMATION<br>②NEXT L1, L2 COLOR IMAGE FORMATION<br>③L0 PART TRANSFER AT A TIME |
| (i) | A B EオFカ<br>C D キGクH<br>A B EオFカ<br>C D キGクH | A3 SIZE(L0) | ①L1 MONOCHROME IMAGE FORMATION<br>②L1 PORTION TRANSFER AT FIRST TIME<br>③L2 MONOCHROME IMAGE, NEXT COLOR IMAGE FORMATION<br>④L2 PORTION TRANSFER AT SECOND TIME |
| (j) | A B オ カ<br>C D キ ク<br>A B オ カ<br>C D キ ク | A3 SIZE(L0) | ①L1 MONOCHROME IMAGE FORMATION<br>②L1 PORTION TRANSFER AT FIRST TIME<br>③L2 COLOR IMAGE FORMATION<br>④L2 PORTION TRANSFER AT SECOND TIME |
| (k) | ア イ EオFカ<br>ウ エ キGクH<br>ア イ EオFカ<br>ウ エ キGクH | A3 SIZE(L0) | ①L1 COLOR IMAGE FORMATION<br>②L1 PORTION TRANSFER AT FIRST TIME<br>③L2 MONOCHROME IMAGE, NEXT COLOR IMAGE FORMATION<br>④L2 PORTION TRANSFER AT SECOND TIME |
| (l) | ア イ E F<br>ウ エ G H<br>ア イ E F<br>ウ エ G H<br>L1 L2<br>L0 | A3 SIZE(L0) | ①L1 COLOR IMAGE FORMATION<br>②L1 PORTION TRANSFER AT FIRST TIME<br>③L2 MONOCHROME IMAGE FORMATION<br>④L2 PORTION TRANSFER AT SECOND TIME |

FIG. 10

| SYMBOL | IMAGE INFORMATION | IMAGE AREA NUMBER | TRANSFER NUMBER |
|---|---|---|---|
| (a) | AアB イCウ DエE オFカ<br>アAイ BウC エDオ EカF<br>AアB イCウ DエE オFカ | N | N |
| (b) | AアB イ ウ エ オ カ<br>アAイ ウ エ オ カ<br>AアB イ ウ エ オ カ | N | 1 |
| (c) | AアB C D E F<br>アAイ B C D E F<br>AアB C D E F | N | 1 |
| (d) | AアB イCウ D E F<br>アAイ BウC D E F<br>AアB イCウ D E F | N | 2 |
| (e) | AアB イCウ エ オ カ<br>アAイ BウC エ オ カ<br>AアB イCウ エ オ カ<br>L1 L2 Ln-1 Ln<br>L0 | N | 2 |

COLOR IMAGE ELECTROPHOTOGRAPHIC APPARATUS FOR PRINTING LONG-SIZE COPY IMAGES

BACKGROUND OF THE INVENTION

The present invention relates to a color image electro-photography apparatus and, more particularly to a color laser beam printer.

The color image electro-photography apparatus can provide a color image by applying an electro-photographic technique. The obtained color image of the color image electro-photography apparatus is recorded and reproduced on a recording medium such as a recording paper.

The present invention relates to a color image electro-photography apparatus in which an overlapped toner image comprised of n colors is transferred on a toner supporting body, such n color overlapped toner image can be recorded and reproduced dividedly on a recording medium in accordance with the length of the image.

As a method for recording and reproducing a color image, there is a method disclosed in Japanese Patent Laid-Open No. 83557/1986. In this first color image formation method, the color image formed on a photosensitive drum is transferred to a recording medium which is carried by a transfer drum. The above stated process is carried out repeatedly so as to obtain the necessary number of colors, for example four times for four colors. Accordingly, this color image is reproduced on a sheet of recording paper as the recording medium.

Herein, this first color image formation method, when the size of the obtained color image is A3 size (420 mm in length; 297 mm in width), for example, the color image formation apparatus employs a photosensitive drum having an outer diameter of 80 mm and a transfer drum having an outer diameter of about 160 mm. The peripheral length of the transfer drum is 502.6 mm.

In a color image formation method disclosed in Japanese Patent Laid-Open No. 76766/1985, the toner image having the necessary number of colors, for example four colors, is developed and formed in order on a photosensitive drum, and this color toner image is transferred onto a recording medium at one time. Accordingly, the color image can be obtained on the recording medium.

In this second color image formation method, when the size of the recording medium is A3 size, it is necessary to use a photosensitive drum having an outer diameter of about 160 mm.

In a color image formation method disclosed in Japanese Patent Laid-Open No. 154465/1984, the photosensitive drum, including development apparatus, is prepared with a necessary number of colors, for example two colors. In this third color image formation method, the toner image having a respective color is formed on a respective photosensitive drum, and the color toner image is transferred in order from the photosensitive drum to a sheet of recording paper. Accordingly, the color image can be obtained on the recording paper.

In a color image formation method disclosed in Japanese Utility Model Laid-Open No. 66870/1988, a photosensitive belt member, including developing apparatus, is prepared so as to obtain the necessary number of colors, for example three colors. In this fourth color image formation method, a toner image having a respective color is formed on a respective photosensitive belt member, and the color toner image is transferred in order from the photosensitive belt member to a sheet of recording paper. Accordingly, the color image can be obtained on the recording paper.

There is a further color image formation method disclosed in Japanese Patent Publication No. 30336/1978, by the inventors of the present invention. In this fifth color image formation method, a sheet of photosensitive paper is run so as to obtain the necessary number of colors in a transportation direction X during a development process and in a return direction Y at the finish of the development process. Accordingly, the color image is recorded on the photosensitive paper To record and reproduce a color image in a color image electro-photography apparatus, there are the following various requirements from the aspect of the manufacturer or the operator.

(a) A requirement to achieve recording and reproduction corresponding to any size (length) of recording medium.

(b) A requirement to achieve the recording of a small (short) record information on a small recording medium in a short time.

(c) A requirement to provide a structure of a small and compact color image electro-photography apparatus.

(d) A requirement to provide a color image electro-photography apparatus having a small number of structural components and a low price.

However, within the above mentioned prior art, in the techniques disclosed in Japanese Patent Laid-Open No. 83557/1986 and Japanese Patent Laid-Open No. 76766/1985, the size of the recording medium is limited due to the outer diameter of the transfer drum and the diameter of the photosensitive drum. Accordingly, the above stated two prior art techniques cannot satisfy the above stated requirement (a).

Further, in the above stated two prior art techniques, the required number of rotations of the transfer drum or the photosensitive drum is constant, and the time required for one rotation of the transfer drum or the photosensitive drum is constant. Therefore, regardless of the size of the recording medium there is no change in the recording time. Accordingly, the above stated two prior art techniques also cannot satisfy the above stated requirement (b).

Further, in the above stated two prior art techniques, making the outer diameter of the photosensitive drum or the outer diameter of the transfer drum large requires that the apparatus be made large, and further it becomes high in cost with regard to a driving source for driving accurately such a large size photosensitive drum or such a large size transfer drum. Accordingly, because of these problems the above stated two prior art techniques cannot satisfy the above stated requirements (c) and (d).

In the prior art techniques disclosed in Japanese Patent Laid-Open No. 154465/1984 and Japanese Utility Model Laid-Open No. 66870/1988, it is possible to satisfy the above stated requirements (a) and (b). However, in these prior art apparatuses, having a large number of the photosensitive drums or a large number of the photosensitive belt members, it is necessary to provide chargers and development apparatuses corresponding in number to the number of photosensitive drums and photosensitive belt members.

Further, it is necessary to maintain accurately the positioning precision between these structural components. Accordingly, the above stated two prior art techniques cannot satisfy the above stated requirements (c) and (d).

In the prior art technique disclosed in Japanese Patent Laid-Open No. 30336/1978, the color image is obtained in accordance with the transportation process and the return-back process of the photosensitive paper. However, it is necessary to have the photosensitive characteristic property in the photosensitive paper itself. Accordingly, in this prior art technique there is no possibility of using conventional paper as the recording medium.

SUMMARY OF THE INVENTION

An object of the present invention is to provide a color image electro-photography apparatus wherein a color image having a large size can be recorded and reproduced in segments on a recording medium.

Another object of the present invention is to provide a color image electro-photography apparatus wherein a record mode for image information can be selected in accordance with the length of the image information.

A further object of the present invention is to provide a color image electro-photography apparatus wherein the length of the image information can be divided and respective divided image information can be recorded and reproduced on a recording medium.

A further object of the present invention is to provide a color image electro-photography apparatus wherein the apparatus can accommodate any size of recording medium.

A further object of the present invention is to provide a color image electro-photography apparatus wherein a color image can be recorded and reproduced on a recording medium in a short time, even when the full length of the recording medium is short.

According to the present invention, a color image electro-photography apparatus comprises a charge means, an exposure means, plural development means for providing a different color toner from each, a toner supporting means, a recording medium transporting means for transporting a recording medium, a transfer means for transferring a color toner image of n colors to the recording medium, a fixing means for fixing the color toner image transferred on the recording medium, and a control means for controlling these means.

When the length of the color image information in the peripheral direction of the toner supporting means is longer than the peripheral length of the toner supporting means, the control means controls the above means to divide the length of the image information into N ($N \geqq 2$) areas, to form the color toner image of n colors existing in every divided area on the toner supporting means, to transfer the color toner image of n colors onto the recording medium, to transfer the color toner image having the length of the color image information onto a corresponding position of the recording medium by carrying out the above process through the control means N times, and to fix the color toner image transferred onto the recording medium through the fixing means.

In a process for carrying out transfer repeatedly N times, during the interval from the first transfer process to the $(N-1)$th transfer process, when the color toner image has a length L on the circumference of the toner supporting means, the control means controls transfer of the color toner image on the recording making the recording medium contact or maintain a minute interval with respect to the toner supporting means, and next by making the recording medium return back a distance (r) while further keeping the recording medium separated from the toner supporting means.

According to the present invention, a color image electro-photography apparatus comprises a photosensitive body, a charge means for charging the photosensitive body, an exposure means for scanning and exposing the photosensitive body in accordance with a light output controlled by color image information, the color image information to be recorded and reproduced having n ($n \geqq 2$) colors and hues, the exposure means forming an electrostatic latent image, a development means for developing the electrostatic latent image, the development means forming a color toner image of n colors on the photosensitive body, the developments having n development units, each respective development unit forming a respective color toner image on the photosensitive body, a recording medium transportation means for mounting and transporting a recording medium, a transfer means for transferring the color toner image of n colors onto the recording medium by contacting the recording medium to the photosensitive body during a transfer process, a fixing means for fixing the color toner image transferred onto the recording medium, and a control means for controlling the above means, in which a charge process, an exposure process and a development process corresponding to the respective hue of the color image information of n colors are carried out repeatedly n times, the color toner image of n colors is formed on the photosensitive body, the color toner image of n colors is transferred onto the recording medium, and the color toner image transferred onto the recording medium is fixed through the fixing means.

When the length ($L_o$) of the color image information in the peripheral direction of the photosensitive body is longer than the peripheral length ($L_k$) of the photosensitive body, the control means controls the above means to divide the length ($L_o$) of the image information into N ($N \geqq 2$) areas, to form the color toner image of n colors existing in each divided area on the photosensitive body, to transfer the color toner image of n colors onto the recording medium, to transfer the color toner image having the length ($L_o$) of the color image information onto each adjacent position of the recording medium by carrying out the above process through the control means N times, and to fix the color toner image transferred onto the recording medium through the fixing means.

In a process for carrying out the transfer repeatedly N times, during the interval from the first transfer process to the $(N-1)$th transfer process, when the color toner image has a length L on the circumference of the photosensitive body, the control means controls transfer of the color toner image on the recording medium by making the recording medium run a distance $(L+r)$ and making the recording medium contact or maintain a minute interval with respect to the photosensitive body, and next by making the recording medium return back a distance (r) while further keeping the recording medium separated from the photosensitive body.

According to the present invention, an overlapped toner image of n colors which is formed on the supporting body can be recorded and reproduced dividedly on the recording medium.

According to the present invention, since the record mode can be selected in accordance with the length ($L_o$) of the image information in the peripheral direction of the photosensitive drum compared with the peripheral length ($L_k$) of the photosensitive drum, the color image can be recorded on a recording paper having a short length in a short time.

For example, in a case in which the length ($L_o$) of the image information in the peripheral direction of the photosensitive drum is shorter than the peripheral length ($L_k$) of the photodrum sensitive drum, the record mode is selected for a one time transfer process so as to record and reproduce the image information.

For example, in a case in which the length ($L_o$) of the image information in the peripheral direction of the photosensitive drum is longer than the peripheral length ($L_k$) of the photosensitive drum, the length ($L_o$) of the image information in the peripheral direction of the photosensitive drum is divided into N areas, the overlapped color toner image is recorded on the respective area of the recording paper.

In the above stated case, the record mode for recording the color image on the full length ($L_p$) of the recording paper can be selected to provide N transfer processes.

Accordingly, it has an effect that the overlapped color image having a large size can be recorded and reproduced with a photosensitive drum having a small outer diameter.

The color image electro-photography apparatus according to the present invention can provide a recorded image to correspond to recording paper having any length.

Further, when the full length ($L_p$) of the recording paper is short, the overlapped color image can be recorded in a short time.

BRIEF DESCRIPTION OF THE DRAWINGS

FIG. 6 is a timing diagram depicting various time sequences showing recording and reproduction of color image information in the color laser beam printer in which the color image information is divided into two areas on the recording paper;

FIG. 8A depicts record image information, showing a combination of the image information including information about the size of the image, color information, etc.;

FIG. 8B depicts other record image information showing a combination of the image information, including information about the size of the image, color information, etc.;

FIG. 8B is recorded on recording paper; and FIG. 10 depicts further record image information, showing a combination of the image information, including information about the size of the image, color information, etc.

DESCRIPTION OF THE INVENTION

Figure 1:
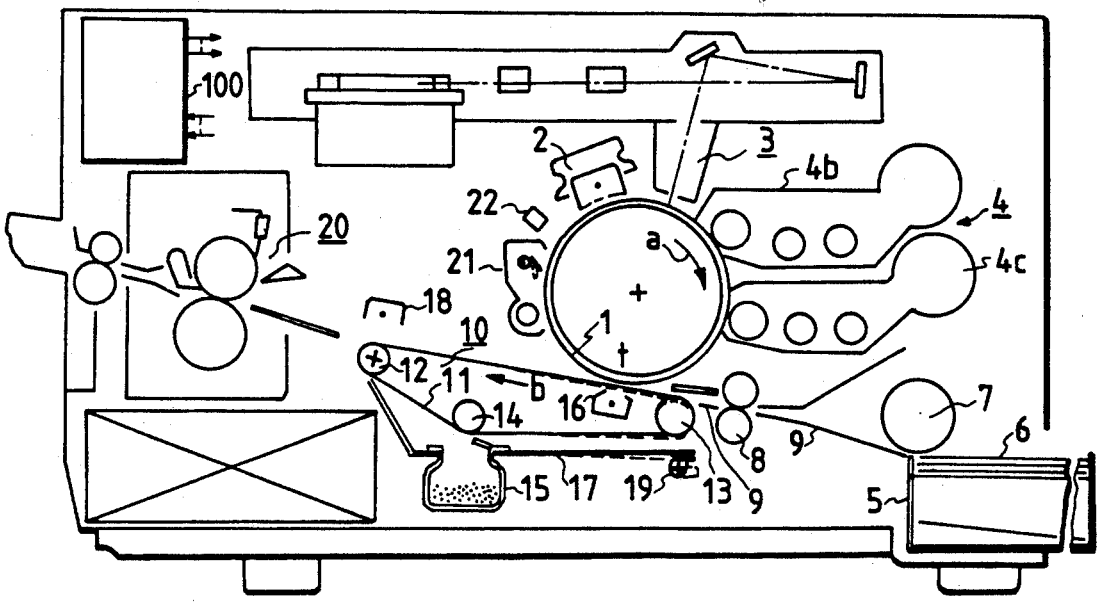
FIG. 1 is a longitudinal cross-sectional side view showing one embodiment of an essential construction of a color laser beam printer according to the present invention.

One embodiment of a color image electro-photography apparatus according to the present invention will be explained in detail referring to the drawings. The sizes of the structural components and the arrangement relations thereof in this embodiment of the color image electro-photography apparatus are merely one example. Further, the sizes of the structural components and the arrangement relations thereof are not limited to this exemplified embodiment.

FIG. 1 is a longitudinal cross-sectional side view showing one embodiment of a color laser beam printer as a color image electro-photography apparatus according to the present invention.

The color laser beam printer comprises mainly a photosensitive drum 1, an electro-static charger 2, an exposure apparatus 3, a development apparatus 4, a recording paper feeding roller 7, a resistor roller 8, a recording paper feeding guide 9, a transfer unit 10, a transfer device 16, an electro-static discharger 18, a fixing apparatus 20 and a control circuit apparatus 100.

The cylindrical shape photosensitive drum 1 has a photosensitive body layer and rotates in the direction of arrow a as shown in FIG. 1. The photosensitive drum 1 has, for example, an outer diameter of 114.5 mm, a circumference (peripheral) length of 360 mm, and an axial length of 304 mm.

The electro-static charger 2 forms uniformly a charge on a surface of the photosensitive drum 1 and is of a construction having a grid member. In this embodiment, the electro-static charger 2 has a characteristic for forming a charge with a negative polarity on the surface of the photosensitive drum 1.

In this embodiment, as shown in FIG. 1, the exposure apparatus 3 comprises a semiconductor laser diode, a rotatable multi-mirror, a scanner motor for rotating the multi-mirror at a high speed, a group of lens for stepping down precisely a laser beam light and a series of mirrors.

While controlling the photo-flash of the laser diode of the exposure apparatus 3 in accordance with image information having respective hues, the exposure apparatus 3 scans in the length direction or rotational direction of the photosensitive drum 1. As a result of carrying out the exposure through the exposure apparatus 3, the electrostatic charge disappears at locations on the drum surface radiated by the light, and an electro-static latent image is formed on the photosensitive drum 1.

In this embodiment, the development apparatus 4 comprises two development units 4*b* and 4*c* for use in the formation of two-colors. However, commonly this kind of development apparatus uses three or four units corresponding to three or four colors in the color developer. In this development apparatus 4, the development unit 4*b* is used for monochrome and the development unit 4*c* is used for color. Thereby each of the image information or the toner image of the monochrome image and the color image is formed by overlapping or developing on the photosensitive drum 1 by the development unit 4*b* and the development unit 4*c*, respectively.

A recording paper 6 accommodated in a cassette 5 is extracted by the recording paper feeding roller 7 and is sent in a forward direction and is put in order by the resist roller 8 so that the feeding timing of the recording paper 6 is adjusted. After that, the recording paper 6 is transported to the transfer unit 10 along the recording paper feeding guide 9. In this embodiment, while transporting the recording paper 6 the transfer unit 10 transfers the image information on the photosensitive drum 1 to the recording paper 6.

The transfer unit 10 includes a transfer belt 11, a paper separation shaft 12, a paper feeding shaft 13, a cleaner facing shaft 14 and a cleaner 15. Each of the paper separation shaft 12, the paper feeding shaft 13 and the cleaner facing shaft 14 is mounted on a side plate of the transfer unit 10. The transfer belt 11 is supported by the three shafts 12, 13 and 14. The recording paper 6, which is transported to this transfer unit 10, is transported to a transfer point t on the photosensitive drum 1 by the transfer belt 11 which moves in the direction of arrow b as shown in FIG. 1.

The transfer device 16 is mounted attachable to the transfer unit 10 and generates a transfer electric field for transferring the image information or the toner image on the photosensitive drum 1 to the recording paper 6. The side plate of the transfer device 16 is fixed to a substrate plate 17.

The electro-static discharger 18 discharges the electric charge on the recording paper 6 and the transfer belt 11 so as to avoid an abnormal discharge when the recording paper 6 is separated from the paper separation shaft 12 and generates AC corona.

Since the transfer belt 11 and the recording paper 6 receive the transfer electric field from the transfer device 16 during the time in which the electro-static discharger 1 is not operated, the transfer belt 11 and the recording paper 6 acquire an electrostatic charge. Accordingly, the recording paper 6 does not slip in place, and the transportation of the recording paper 6 is stable.

Further, when the overlapped toner image on the photosensitive drum 1 is transferred to the recording paper 6, the transfer unit 10 is shifted in an upward direction by a cam mechanism 19 so as to contact the photosensitive drum 1 with the recording paper 6. The transfer unit 10 may be pushed in the upward direction by the cam mechanism 19 so as to have a very small spacing, for example about 10–30$\mu$ degree, from the photosensitive drum 1 and the recording paper 6.

However, during the non-transfer time, the transfer unit 10 is shifted down to the dashed line position as shown in FIG. 1, and the photosensitive drum 1 and the recording paper 6 are positioned by the cam mechanism 19 so as not to be in contact. The fixing apparatus 20 fixes the transferred toner image on the recording paper 6.

After the above transfer process, a cleaning apparatus 21 for removing the residual toner image on the photosensitive drum 1 contacts the photosensitive drum 1 during the cleaning operation, however otherwise the cleaning apparatus 21 is retracted to the dashed line position shown in FIG. 1 and does not contact the photosensitive drum 1.

An eraser 22 removes entirely the electric charge on the photosensitive drum 1 by radiating light onto the photosensitive drum 1.

A control circuit apparatus 100 comprises mainly a microprocessor. The control circuit apparatus 100 controls the above stated various apparatuses in accordance with a command signal or an image signal from an upper rank image information generating apparatus and a signal from an operation panel provided on the color laser beam printer or signals from the various sensors. Further, the control circuit apparatus 100 carries out the recording and reproduction process described hereinafter.

Figure 2:
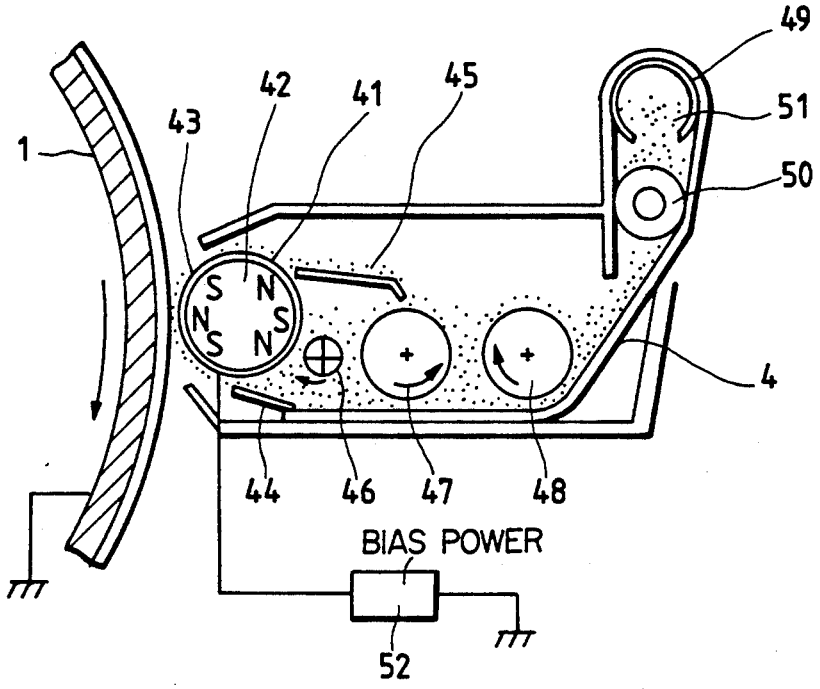
FIG. 2 is a longitudinal cross-sectional side view showing a development apparatus of the color laser beam printer shown in FIG. 1.

FIG. 2 is a longitudinal cross-sectional side view illustrating the development apparatus 4 of the color laser beam printer.

The development apparatus 4 comprises a development sleeve 41, a magnet 42, a development agent layer thickness regulating blade 44, a residual development agent removing blade 45, three development agent agitating screws 46, 47 and 48, a toner cartridge 49 and a toner supply roller 50.

The development sleeve 41 is made of a non-magnetic material such as aluminum. The magnet 42 is provided on the development sleeve 41 at a peripheral location, and this magnet 42 has a plurality of magnetic poles (in this case, six poles). The agent regulating blade 44 regulates the thickness of a layer of development agent 43 which is formed on the development sleeve 41. The agent removing blade 45 removes residual development agent on the development sleeve 41 after the development process. Each of the agent agitating screws 46, 47 and 48 agitates the development agent 43.

In this embodiment of the present invention, the development 51. The magnetic carriers have a grain size of about 100$\mu$, and the toners 51 have a grain size of about 10$\mu$, respectively. The magnetic carriers and the toners 51 are mixed at a weight percent ratio of 100:3. During agitation by screws 46, 47 and 48, the magnetic carriers and the toners 51 are charged frictionally and electrostatically. In this example, the toners 51 are charged with a negative polarity and the magnetic carriers are charge with a positive polarity, respectively. The magnetic carriers and the toners 51 are electrostatically absorbed and combined with each other.

Due to the rotation of the toner supply roller 50, which is made of a multi-porous material such as a sponge-like rubber etc., the toner cartridge 49 supplies toner 51 in a proper amount into the development apparatus 4.

As shown in FIG. 2, a bias power source 52 for development is connected to the development sleeve 41 for the development apparatus 4. This development bias power source 52 supplies a driving voltage for development to the development sleeve 41.

For example, the initial electrostatic charge voltage $V_o$ of the photosensitive drum 1 may be −650 V, the voltage Vr after the exposure process may be −100 V, the peripheral speed of the photosensitive drum 1 may be 300 mm/s, the gap between the photosensitive drum 1 and the development sleeve 41 may be about 1 mm, and the thickness of the layer of the development agent 43 adhered to the development sleeve 41 may be about 0.5 mm.

In the above condition, the driving voltage for development with a square wave form can be set as following. Namely, the driving voltage for development is set at a frequency of 2 KHz, an amplitude of about 700 Vp-p, and a direct current bias voltage of −350 V.

In the above condition for the development system, the toner 51 adheres in a proper amount to the exposed portion of the photosensitive drum 1. Thereby, this embodiment of the color image electro-photography apparatus can record and reproduce the information image or the overlapped toner image in excellent quality.

Further, in the above embodiment of the color image electro-photography apparatus, the development system is used as a reversal development system. This reversal development system employs a non-contact development system in which the photosensitive drum 1 does not contact the layer of the development agent 43.

As stated before and shown in FIG. 1, this embodiment of the color image electro-photography apparatus has two development units 4*b* and 4*c*. These two development units 4*b* and 4*c* employ respectively the development apparatus structure shown in FIG. 2.

Figure 3:
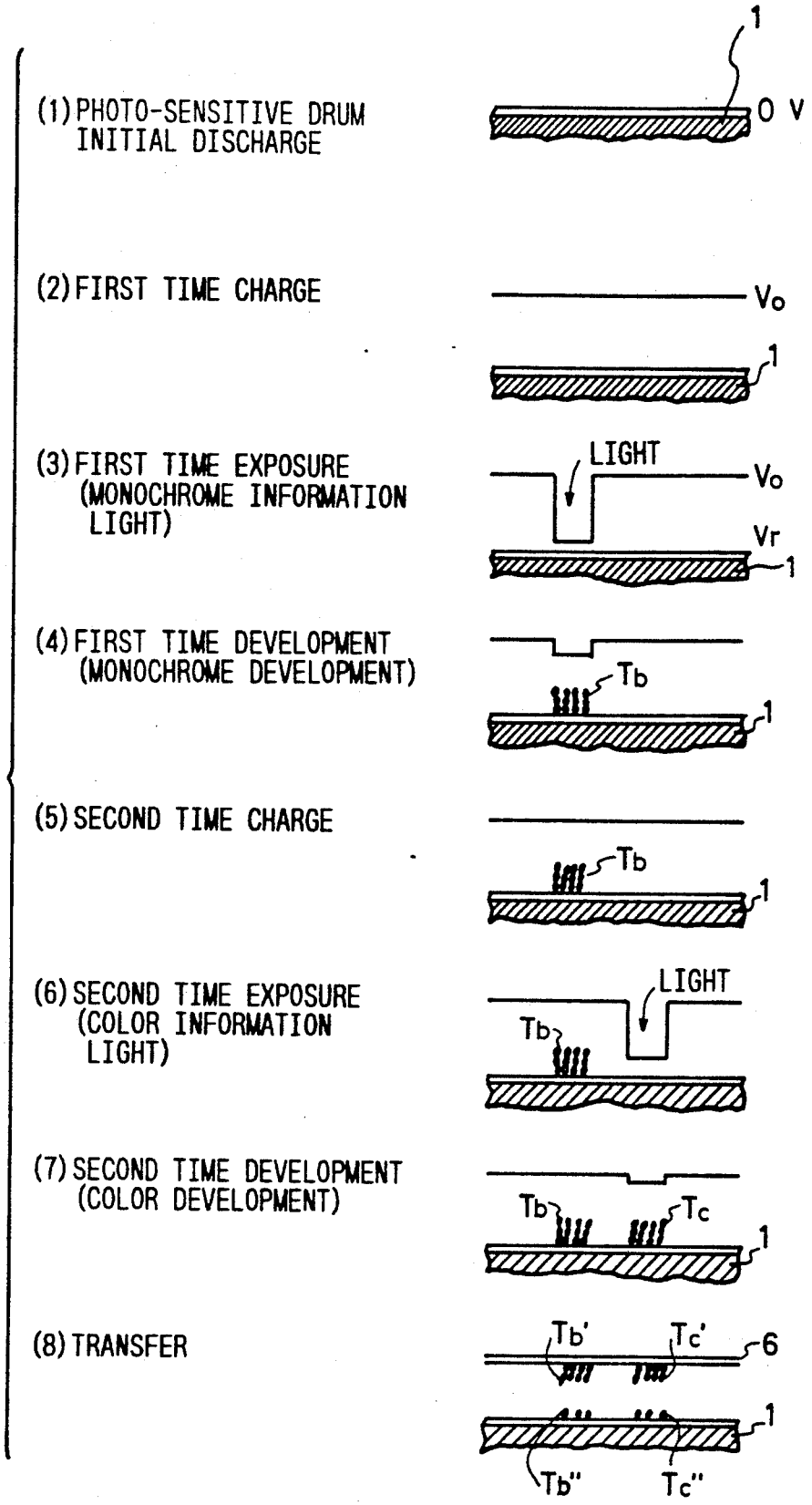
FIG. 3 is an explanatory diagram for a two-color process using the color laser beam printer according to the present invention.

FIG. 3 is an explanatory view showing an electro-photography printing process for forming a two-color toner image on the photosensitive drum 1 of the color image electro-photography apparatus according to the present invention.

Step (1) Initial photosensitive drum electrostatic discharge process

The photosensitive drum 1 is radiated uniformly with light by the eraser 22 so that the initial voltage of the photosensitive drum 1 is approximately 0 V.

Step (2) First time electrostatic charge process

The photosensitive drum 1 is electrostatically charged uniformly with a negative polarity by the electrostatic charger 2, thereby acquiring an initial electrostatic voltage $V_o$ of, for example −650 V.

Step (3) First time exposure process

The exposure device 3 generates the laser beam light which is controlled by the image signal. The laser beam light lights and scans the photosensitive drum 1. By extinguishing the electrostatic charged voltage at the light exposed portion, the laser beam light forms an electrostatic latent image on the photosensitive drum 1. The voltage $V_r$ on the light exposed portion becomes −100 V.

In this embodiment, the monochrome information light is radiated the first time on the photosensitive drum 1.

Step (4) First time development process

Due to the first time exposure process as stated above in step (3), a latent image has been formed by the monochrome information light on the photosensitive drum 1.

In this step (4), the electrostatic latent image on the photosensitive drum 1 is developed through the development apparatus 4*b*, so that monochrome toner $T_b$ adheres to the light exposed portion, thereby forming a monochrome toner image $T_b$.

Step (5) Second time exposure process

The photosensitive drum 1 is electrostatically charged again through the electrostatic charger 2. And the voltage $V_o$ of the photosensitive drum 1 is again −650 V.

Step (6) Second time exposure process

By controlling the laser beam light of the exposure device 3 through the color information signal, and also by lighting and scanning the photosensitive drum 1, an electrostatic latent image is formed. The voltage $V_r$ of the light exposed portion becomes −100 V degree.

The same exposure device 3 is employed for both the monochrome information and the color information.

Step (7) Second time development process

The tone image on the photosensitive drum 1 is developed in accordance with the operation of the development unit 4*c*, so that a color toner image $T_c$ is formed on the photosensitive drum 1.

In both steps (4) and (7) of the development processes, the monochrome toner image $T_b$ and the color toner image $T_c$ are formed by overlapping on the photosensitive drum 1.

Step (8) Transfer process

The transfer electric field is applied from the rear surface of the recording paper 6, so that an overlapped two-color toner image, made up of the monochrome toner image $T_b$ and the color toner image $T_c$ on the photosensitive drum 1, is transferred. The overlapped two-color toner image is recorded and reproduced on the recording paper 6.

This recording paper 6 is fixed by the fixing apparatus 20, so that the permanent image is fixed.

Residual monochrome toner $T_b''$ and residual color toner $T_c''$ are left on the photosensitive drum 1. These residual toner images $T_b''$ and $T_c''$ are removed by the cleaner 21. Accordingly the drum is prepared for the next record.

In the above embodiment according to the present invention, the two-color image recording process for forming a two-color image on the photosensitive drum 1 is explained.

However, two development apparatuses for color may be disposed on the color image electro-photography apparatus. In such a case the apparatus can record and reproduce a full-color image.

When this apparatus having two development apparatuses 4 for color is employed, a process for forming a four-color toner image on the photosensitive drum 1 will be explained as follows, referring to the steps shown in the above process for forming the two-color toner image.

Before the transfer step (8) the steps from steps (1) to (7) are carried out repeatedly, and further after forming the four-color toner image on the photosensitive drum 1, the transfer step (8) is carried out. Thereby it is possible to record and reproduce the full-color image.

An indicator is provide on the cassette 5 shown in FIG. 1. The indicator provides an information signal as to the size of the recording paper 6 etc. to the control circuit apparatus 100. A sensor reads the indicator mounted on the cassette 5 and inputs the information signal indicative of the mounted cassette 5 into the control circuit apparatus 100.

In this embodiment of the color laser beam printer according to the present invention, the photosensitive drum 1 has a surface area for forming a toner image having an A4 size. Accordingly, when the recording paper 6 accommodated in the cassette 5 has an A4 size, the control circuit apparatus 100 can control the recording of the color image information by the above stated electro-photography printing process, referring to the steps of the various processes shown in FIG. 3.

However, this photosensitive drum 1 does not have a surface area permitting forming a toner image having an A3 size. Accordingly, when an operator wants to record a color image on recording paper 6 of A3 size (420 mm in length; 297 mm in width), the control circuit apparatus 100 operates in accordance with the color image record and reproduction control set forth below.

Figure 4:
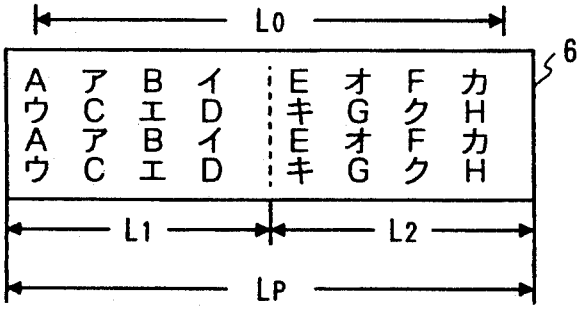
FIG. 4 is an explanatory diagram showing a record for a color image using the color laser beam printer according to the present invention.

FIG. 4 is an explanatory diagram showing color image information for recording and reproduction on recording paper 6 of A3 size. For example, let the kana characters be a monochrome image, the English characters be a color image, and $L_o$ be the image length in the peripheral direction of the photosensitive drum 1.

The control circuit apparatus 100 controls the above stated various apparatuses. The control circuit apparatus 100 divides the recording paper 6, having a peripheral direction length $L_p$ into two areas $L_1$ and $L_2$. The control circuit apparatus 100 further divides the image information corresponding to these areas, so that the overlapped toner image formation and the transfer of the toner images can be carried out for every area $L_1$ and $L_2$ of the recording paper 6.

First of all, with respect to the area $L_1$ of the recording paper 6, in accordance with the above stated electro-photography printing process referring to FIG. 3, the overlapped two-color toner image is formed and transferred according to the color image information onto the area $L_1$ of the recording paper 6.

Next, with respect to the remaining area $L_2$, again, in accordance with the above stated electro-photography printing process referring to FIG. 3, the overlapped two-color toner image is formed and transferred according to the color image information onto the are $L_2$ of the recording paper 6. Thereby the color image information having the length of $L_o$ is recorded and reproduced on the recording paper 6. Further, the areas $L_1$ and $L_2$ divided on the recording paper 6 are not necessarily divided equally.

Herein, after the toner image is transferred to the area $L_1$ of the recording paper 6, by separating the recording paper 6 from the photosensitive drum 1, the recording paper 6 and the photosensitive drum 1 do not contact each other. Therefore it is possible to freely make the toner image formation for the area $L_2$ of the recording paper 6 on the photosensitive drum 1.

For the sake of the above stated aim, in this embodiment of the present invention, during the non-transfer time of the color laser beam printer, the transfer unit 10 shifts down as shown in the dashed line in FIG. 1, so that the recording paper 6 and the photosensitive drum 1 do not contact each other. Further, the transfer belt 11 and the recording paper 6 in the color laser beam printer are stopped.

FIGS. 5A–5D show relationships of the movement of the recording paper 6 with respect to he photosensitive drum 1 according to this embodiment of the present invention.

Figure 5A:
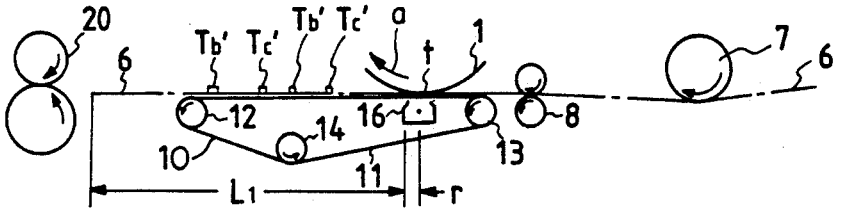
FIG. 5A is a diagrammatic view showing a running condition of a recording paper in which the recording paper is run an extra distance in the color laser beam printer according to the present invention.

In FIG. 5A, in a process for forming a toner image $T_b'$ and a toner image $T_c'$ in the area $L_1$ portion of the recording paper 6, the recording paper 6 is caused to run an extra distance r. The toner image is not formed on the surface of the photosensitive drum 1 corresponding to the extra transported length portion r of the recording paper 6. Accordingly, the surface of the photosensitive drum 1, which corresponds to the extra length portion r of the recording paper 6 is maintained in a cleaned condition and does not transfer anything onto the recording paper 6.

Figure 5B:
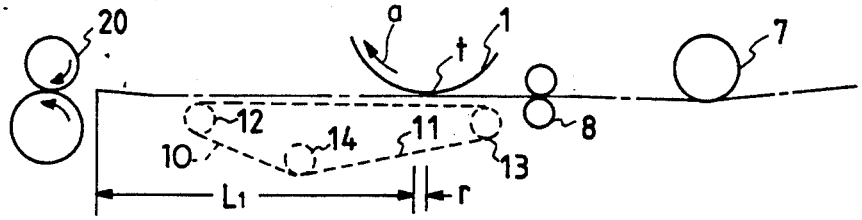
FIG. 5B is a diagrammatic view showing a running condition of the recording paper in which a transfer unit is shifted down in the color laser beam printer according to the present invention.

FIG. 5B shows a condition in which the contact between the photosensitive drum 1 and the recording paper 6 is released due to the lowering-down or shifting-down of the transfer unit 10.

Here it comes up as an important matter that, as shown in FIG. 5B, the recording paper 6 has run the extra distance r. If the recording paper 6 were not run the extra length portion r and the recording paper 6 were moved downwardly, then the toner image might disturb the rear portion of the area $L_1$ of the recording paper 6.

However, as shown in this embodiment of the present invention, when the recording paper 6 is transported the extra length portion r, even though the recording paper 6 moves downwardly there is no degradation of the toner image in the rear portion of the area $L_1$ of the recording paper 6.

In this case according to this embodiment of the present invention, when the recording paper 6 is transported a length $(L_1+r)$ beyond the transfer point t on the photosensitive drum 1, it is important that the relative positional relation between the transfer point t on the photosensitive drum 1 and the fixing apparatus 20 be of a length such that the tip portion of the recording paper 6 does not engage with a heated roller of the fixing apparatus 20.

The reason for this is that when the recording paper 6 is inserted in the fixing apparatus 20, the recording paper 6 is heated and changes its characteristic property, so that it cannot obtain a good transfer result for the toner image after that.

Further, when the recording paper 6 is made to return back the extra transported distance r, it would be necessary to do a reverse rotation of the fixing apparatus 20, and accordingly, it would cause a problem with respect to the control in the color laser beam printer.

Figure 5C:
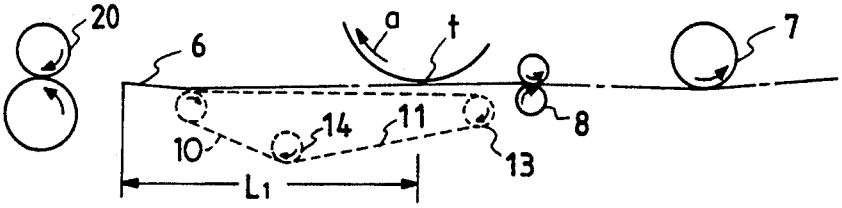
FIG. 5C is a diagrammatic view showing a running condition of the recording paper in which the recording paper is returned back the extra distance in the color laser beam printer according to the present invention.

FIG. 5C shows a process in which the extra transported portion r of the recording paper 6 is returned back. In this case, such a return-back process for the recording paper 6 is carried out under a non-contact condition between the recording paper 6 and the photosensitive drum 1. So as to return back accurately the recording paper 6, both the resist roller 8 and the transfer unit 10 may rotate in reverse.

A pulse motor can be used for the driving source for the reverse rotation of the resist roller 8 and the transfer unit 10. Further by controlling the number of pulses applied to the pulse motor as the transporting and return-back for the recording paper 6 is carried out, dislocation on the connecting portion of areas $L_1$ and $L_2$ on the recording paper 6 can be kept less than 0.1 mm. Such a dislocation amount on the recording paper 6 is less than the resolving power of a person's eye, and so this causes no practical problem.

Further, in accordance with the shifting-up and shifting-down movement (about 2 mm) of the transfer unit 10 with respect to the photosensitive drum 1, in other words the contact condition or the non-contact condition between the photosensitive drum 1 and the recording paper 6, in a case in which the precise cam mechanism is controlled by the control circuit apparatus 100, the positioning and the arrangement for the recording paper 6 can be performed accurately in a short time.

Figure 5D:
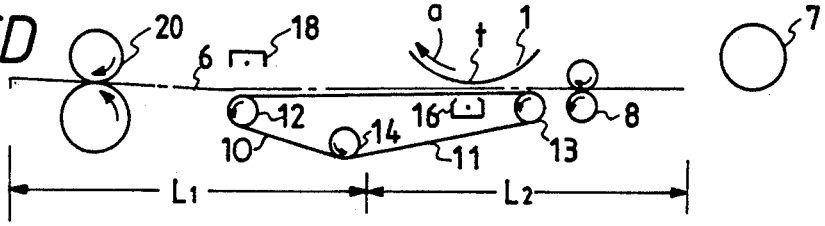
FIG. 5D is a diagrammatic view showing a running condition of the recording paper in which the transfer unit is shifted up in the color laser beam printer according to the present invention.

FIG. 5D shows the electro-photography printing process in which the toner image is recorded and reproduced on the area $L_2$ portion of the recording paper 6. By raising up the transfer unit 10, the positional relation between the photosensitive drum 1 and the recording paper 6 can be controlled and maintained.

Further, in the electro-photography printing process shown in FIGS. 5A–5D, the photosensitive drum 1 can rotate at all times in the direction of the arrow mark a, just as in FIG. 1.

TABLE 1

| Components | | Spacing | Movement Time (Sec.) |
|---|---|---|---|
| charger | exposure apparatus | 35° | 0.35 |
| exposure apparatus | development unit (4b) | 40° | 0.4 |
| exposure apparatus | development unit (4c) | 90° | 0.9 |
| development unit (4c) | transfer point t | 88° | 0.88 |
| resist roller | transfer point t | 77 mm | 0.77 |
| transfer point t | fixing apparatus | 260 mm | 2.6 |
| transfer point t | cleaner | 77° | 0.77 |
| cleaner | eraser | 35° | 0.35 |
| eraser | charger | 35° | 0.35 |
| cleaner | charger | 70° | 0.7 |
| charger | transfer point t | 213° | 2.13 |

The above table 1 shows the relative positional relations of each of the components of the color laser beam printer shown in FIG. 1.

For example, let the peripheral length of the photosensitive drum 1 be 360 mm and let the peripheral speed of the photosensitive drum 1 be 100 mm/s, the necessary time for one rotation for the photosensitive drum 1 becomes 3.6 second, and the angular speed becomes 0.01 second per 1°.

Each of the movement speeds of the resist roller 8, the recording paper feeding roller 7, the fixing apparatus 20 and the transfer unit 10 in the color laser beam printer is set at about 100 mm/s, respectively. The distance from the transfer point t of the photosensitive drum 1 to the fixing apparatus 20 is set at 260 mm. Accordingly, in the process stated above and as shown in FIG. 5, since the recording paper 6 is transported the extra length portion r, proper timing assures that the tip end portion of the recording paper 6 is not inserted into the fixing apparatus 20.

FIG. 6 is a time sequence explanatory diagram showing the recording and reproduction of the color image information on long recording paper 6.

In FIG. 6, the long recording paper 6 having a length longer than the peripheral length of the photosensitive drum 1 (in this embodiment of the present invention, 360 mm), for example A3 size recording paper (420 mm in length, 297 mm in width), is divided into two area portions namely area portion $L_1$ and area portion $L_2$ of the long recording paper 6 as shown in FIG. 5D. Thereby the overlapped color image information is recorded and reproduced on the long recording paper 6 of A3 size.

Let each area portion $L_1$ and $L_2$ be 210 mm. The first image photosensitive drum 1.

In a case in which the charger 2 is defined as the base point (T=0), the eraser 22 turns on its light and the photosensitive drum 1 is rotated in the direction of the arrow a, and charger 2 is in the operational condition.

#1: Since the movement time from the charger 2 to the exposure apparatus 3 (the movement time of the photosensitive drum 1) is 0.35 second, after 0.35 second from the base point (T=0), the control for the light output of the exposure apparatus 3 can start according to the monochrome information signal.

The ON time of the exposure apparatus 3 is a maximum time of 2.1 second in this embodiment of the present invention, since each area portion $L_1$ and $L_2$ of the recording paper 6 has a length of 210 mm.

#2: The movement time from the exposure apparatus 3 to the development unit **4*b* is 0.4 second. After elapse of 0.4 second from the above stated process #1, the development unit 4*b* is made to operate. Thereby the monochrome toner image $T_b$ corresponding to the monochrome information is formed on the photosensitive drum 1**.

As a practical matter, before this process the exposure apparatus 3 is turned OFF, and the electrostatic latent image is not formed on the photosensitive drum 1. Even though the development unit **4*b* is made to operate, a toner image is not formed on the photosensitive drum 1. Therefore, at the base point (T=0) of the charger 2, the development unit 4*b*** is made to operate.

#3: The eraser 22 is operated on for one rotation of the photosensitive drum 1. The eraser 22 is turned OFF so as not to radiate the portion of the photosensitive drum 1 on which the toner image is formed.

Namely, after the movement time (2.5 second) from the development unit **4*b* to the eraser 22, the eraser 22** is turned OFF.

#4: After the photosensitive drum 1 has traveled a revolution (3.6 second) and after the photosensitive drum 1 has traveled the distance (a total of 3.95 seconds) from the charger 2 to the exposure apparatus 3, the photosensitive drum 1 is exposed by controlling the exposure apparatus 3 in accordance with the image information corresponding to the color information, and then the electrostatic latent image is formed.

#5: After the movement time (0.9 second) of the photosensitive drum 1 from the exposure apparatus 3 to the development unit **4*c*, the development unit 4*c* is made to operate, and then the color toner image $T_c$ is adhered to the photosensitive drum 1 corresponding to the color information. Therefore, the overlapped toner image on the photosensitive drum 1** has a two-color image comprised of the monochrome toner image $T_b$ of #2 above and the color toner image $T_c$ of this #5.

#6: The movement time of the photosensitive drum 1 from the development unit **4*c* to the transfer point t on the photosensitive drum 1 is 0.88 second. The movement time of the recording paper 6 from the resist roller 8 to the transfer point t on the photosensitive drum 1** is 0.77 second.

Taking account of this difference in time, after the lapse of 0.11 second from the operation of the development unit **4*c*, the resist roller 8 is made to start, and then the recording paper 6 is transported accurately to the transfer point t on the photosensitive drum 1. #7: Before the tip end portion of the recording paper 6 reaches the transfer point t on the photosensitive drum 1 in #6 above, the transfer unit 10 is shifted up, and the transfer belt 11 is made to contact the photosensitive drum 1. Further, the transfer means 16** is made to operate.

#8: After the tip end portion of the recording paper 6 reaches the transfer point t on the photosensitive drum 1 and the photosensitive drum 1 is moved toward the cleaner 21, the required time for this movement is 0.77 second, and so after the lapse of 0.77 second the cleaner 21 is made to operate for one revolution (3.6 seconds).

#9: After the lapse of 0.25 second from the operation of the cleaner 21, the eraser 22 is made to operate for one revolution (3.6 seconds).

#10: After the tip end portion of the recording paper 6 has passed through the transfer point t on the photosensitive drum 1, the overlapped two-color image is transferred to the area which exists in a portion of 210 mm from the tip end portion of the recording paper 6 (the lapse of time is 2.1 seconds).

Further, the recording paper 6 is transported the extra length portion r (in this embodiment of the present invention, the length is 30 mm and the time is 0.3 second). Then immediately the transfer unit 10 is shifted down and the photosensitive drum 1 and the recording paper 6 are separated from each other.

#11: Next, the resist roller 8 and the transfer belt 11 are rotated in reverse for 0.3 second, and the recording paper 6 is returned back the distance r, accurately positioning the portion a distance $L_1$ from the tip end portion of the recording paper 6 at the transfer point t on the photosensitive drum 1.

In the above stated processes from #1 to #11, the overlapped two-color toner image can be recorded and reproduced on the area $L_1$ of the recording paper 6.

Next, with respect to recording on area $L_2$ of the recording paper 6, operation is repeated fundamentally according to the above stated time sequence. This time sequence for recording on area $L_2$ of the recording paper 6 is shown in FIG. 6.

After the overlapped two-color toner image has been transferred on both area $L_1$ and area $L_2$ of the recording paper 6, the recording paper 6 is transported to the fixing apparatus 20, and the fixing process is carried out.

By carrying out the above stated various processes, the two-color image shown in FIG. 4 can be obtained.

Figure 7:
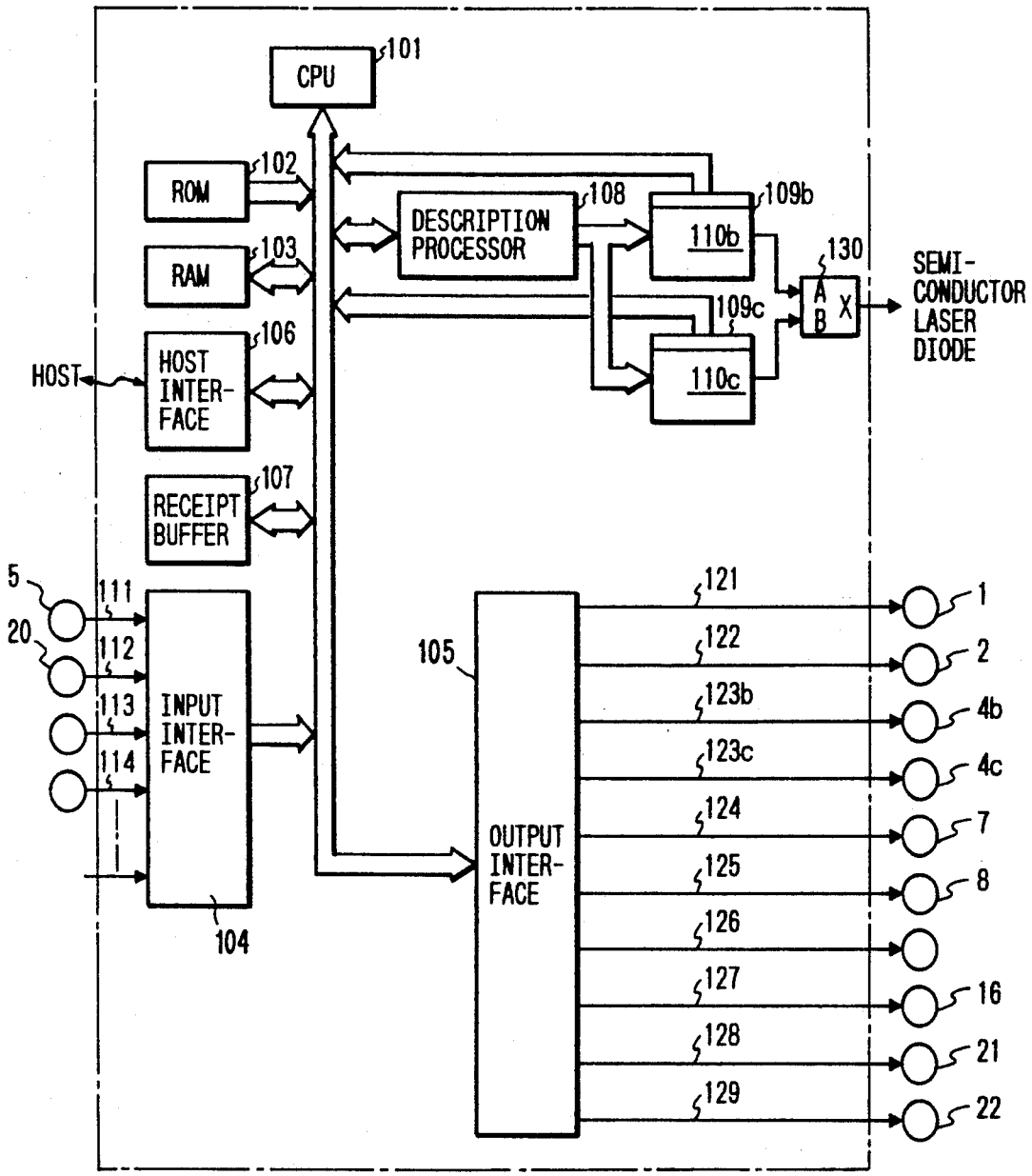
FIG. 7 is a block diagram showing a control circuit apparatus in the color laser beam printer according to the present invention.

FIG. 7 is a block diagram showing the control circuit apparatus 100. The control circuit apparatus 100 comprises CPU 101, ROM 102 for storing the control program, RAM 103 for working, an input interface means 104 for receiving input signals from the various sensors, an output interface means 105 for outputting the output signals to the various electric loads, a host interface means 106 for receiving the encoded data from an upper rank host which indicates the electro-photography printing to the color laser beam printer, and a receipt buffer means 107 for storing temporarily the encoded data.

The control circuit apparatus comprises further a description processor 108 for developing the encoded data to the image signal, a monochrome image signal description memory **110*b* for storing the monochrome image signal developed by the description processor 108, and a color image signal description memory 11? c for storing the color image signal developed by the description processor 108**.

Various signals are inputted in the input interface means 104. For example, the signals such as a recording paper size signal 111 from the cassette 5, a temperature information signal 112 from the fixing apparatus 20, a jam detection signal 113 of the recording paper 6, and a position signal 114 from the pulse motor for driving the resist roller 8 and the transfer belt 11 are inputted respectively in the input interface means 104.

Various signals are outputted from the output interface means 105. For example, the signals such as a photosensitive drum motor drive signal 121 for driving the photosensitive drum 1, a charge high voltage source control signal 122 for the charger 2, a monochrome development apparatus control signal **123*b* for driving the monochrome development apparatus 4*b*, and a color development apparatus control signal 123*c* for driving the color development apparatus 4*c* are outputted from the output interface means 15**.

A paper feeding control signal 124 for controlling the paper feeding roller 7, a resist control signal 125 for controlling the resist roller 8, a pulse motor drive signal 126 for driving the resist roller 8 and the transfer belt 11, a cam mechanism control signal for controlling the cam mechanism 19 which moves the transfer unit 10 in the upward direction or the downward direction, a transfer high voltage source control signal 127 for the transfer means 16, a cleaning control signal 128 for controlling the cleaning apparatus 21, and an eraser control signal 129 for controlling the eraser 22 are outputted respectively from the output interface 105.

The input interface means 104 and the output interface means 105 operate respectively in accordance with the time chart shown in FIG. 6 under control of CPU 101 in accordance with the control programs stored in ROM 102 of the control circuit apparatus 100.

Further, the pulse motor drives the resist roller 8 and the transfer belt 11 and controls the resist roller 8 and the transfer belt 11 for normal rotation or reverse rotation according to the position information 114 from the pulse motor. Accordingly, the pulse motor can transport or return back (return-back amount: r) accurately the recording paper 6.

At first, the encoded data is inputted into the host interface means 106 from the upper rank host. Further, by entering the encoded data into the receipt buffer means 107 which stores it temporarily, CPU 101 inputs this encoded data into the description processor 108.

In the description processor 1008, the encoded data is analyzed and the monochrome image signal is provided to the monochrome image signal description memory **110*b* and the color image signals are provided to the color image signal description memory 110*c***. Thereby the image information can be obtained.

Further, the description memory 110 includes the monochrome image signal description memory **110*b* and the color image signal description memory 110*c* and, for example in a case in which the image information is stored 100 numbers per 1 $mm^2$ with respect to an image of A3 size, stores $297 \times 420 \times 100 = 12{,}474{,}000$ numbers. Accordingly, in this embodiment of the color laser beam printer, the capacity of the description memory 110** is 12.47M bits.

The contents of the monochrome image signal description memory **110*b* and the color image signal description memory 110*c*** are stored accurately in order according to the size of the image.

By detecting both the existence of the image information indicating which color is to be in which area and the recording paper size signal 111 from the cassette 5 indicating whether the image is A3 size or A4 size, with respect to the respective areas $L_1$ and $L_2$ the most suitable division boundary and the shortest printing time can be obtained according to this embodiment of the present invention.

One example of the recording image will be explained referring to FIG. 8A and FIG. 8B. There are various combinations of the record image as shown in FIG. 8A and FIG. 8B. For example, the size of the record image is A3 size or A4 size, and the color information of the record image is a combination of monochrome and color.

With respect to the information of this record image, it is necessary to determine the following matters.

(1) The size of the image information, for example, whether the image information is A3 size or A4 size.

(2) The color in the color information, for example, whether it is a single color (only monochrome or only one color), and whether two-color information comprises monochrome and a color.

(3) In case of two-color information, the area for which the monochrome image signal exists and the area for which the color image exists.

The above stated determination (1) is made from the recording paper size signal 111 from the cassette 5.

The above stated determination (2) is made from single color information or two-color information in accordance with an area pointer 109, comprising a monochrome area pointer 109*b* and a color area pointer 109*c*. The monochrome area pointer 109*b* of the area pointer 109 is used for the monochrome image signal of the description memory 110*b* in which the monochrome information is stored. The color area pointer 109*c* of the area pointer 109 is used for the color image signal of the description memory 110*c* in which the color information is stored.

With respect to the above stated determination (3), the existence of each image signal is determined for every respective area in accordance with the monochrome area pointer 109*b* for the monochrome image signal and in accordance with the color area pointer 109*c* for the color image signal.

For example, the area of the description memory 110 holds A3 size of the image information divided into two, and this description memory 110 comprises the monochrome description memory 110*b* and the color description memory 110*c*. In this case, in accordance with the result of the area pointer 109, it may be determined whether the image signal exists within the previous divided half area of the description memory 110 for A3 size or the image signal exists within the latter divided half area of the description memory 110 for A3 size.

Further, the monochrome image signal or the color image signal is selected by a selector 130, and the selected image signal is inputted into the semiconductor laser diode apparatus 3. By controlling the photo-flash of the laser of the exposure apparatus 3, the electrostatic latent image is formed on the photosensitive drum 1.

Figure 9A:
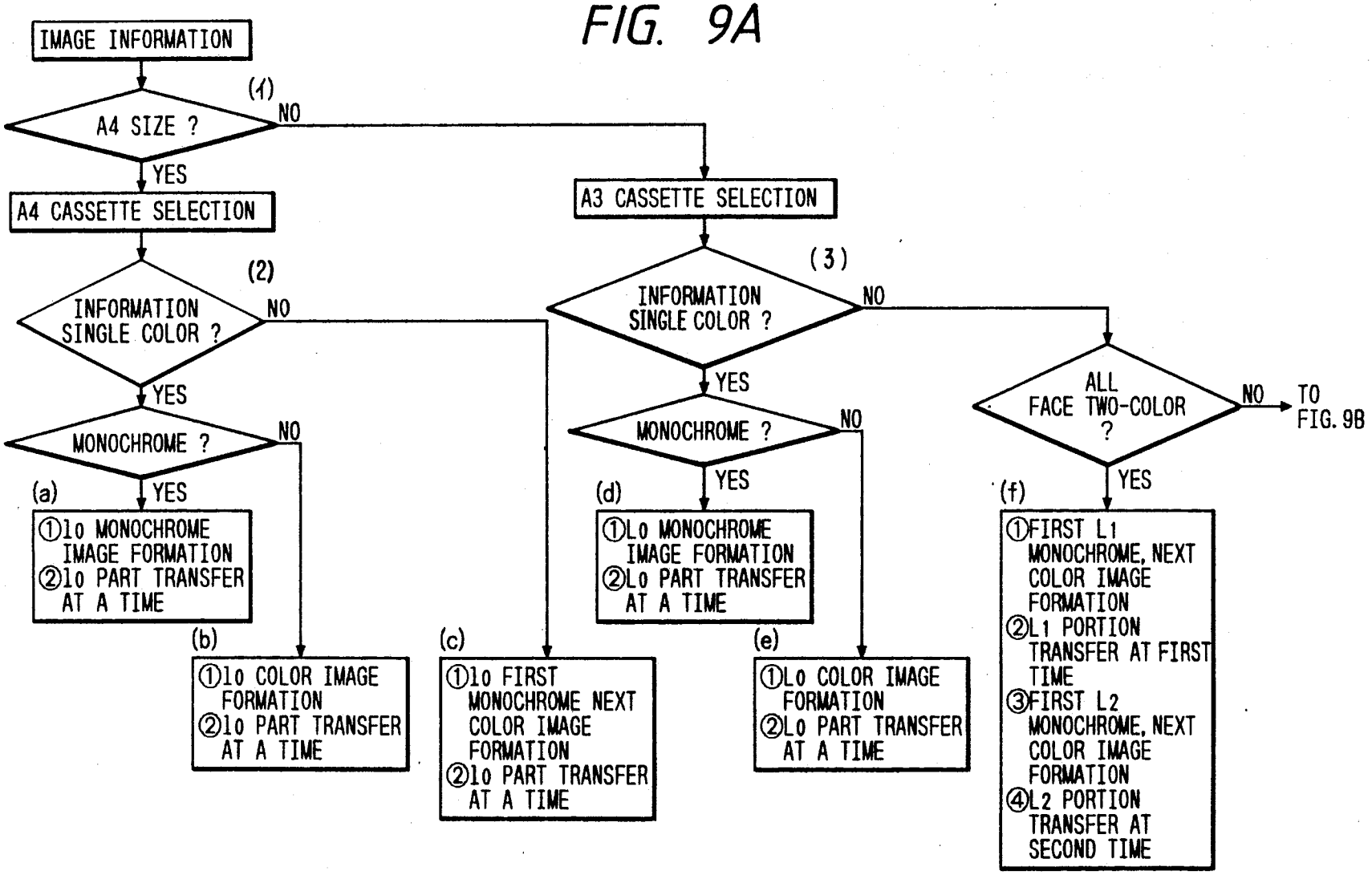
FIG. 9A and FIG. 9B are flow-charts for the image formation process in which the image information shown in FIG. 8A
Figure 9B:
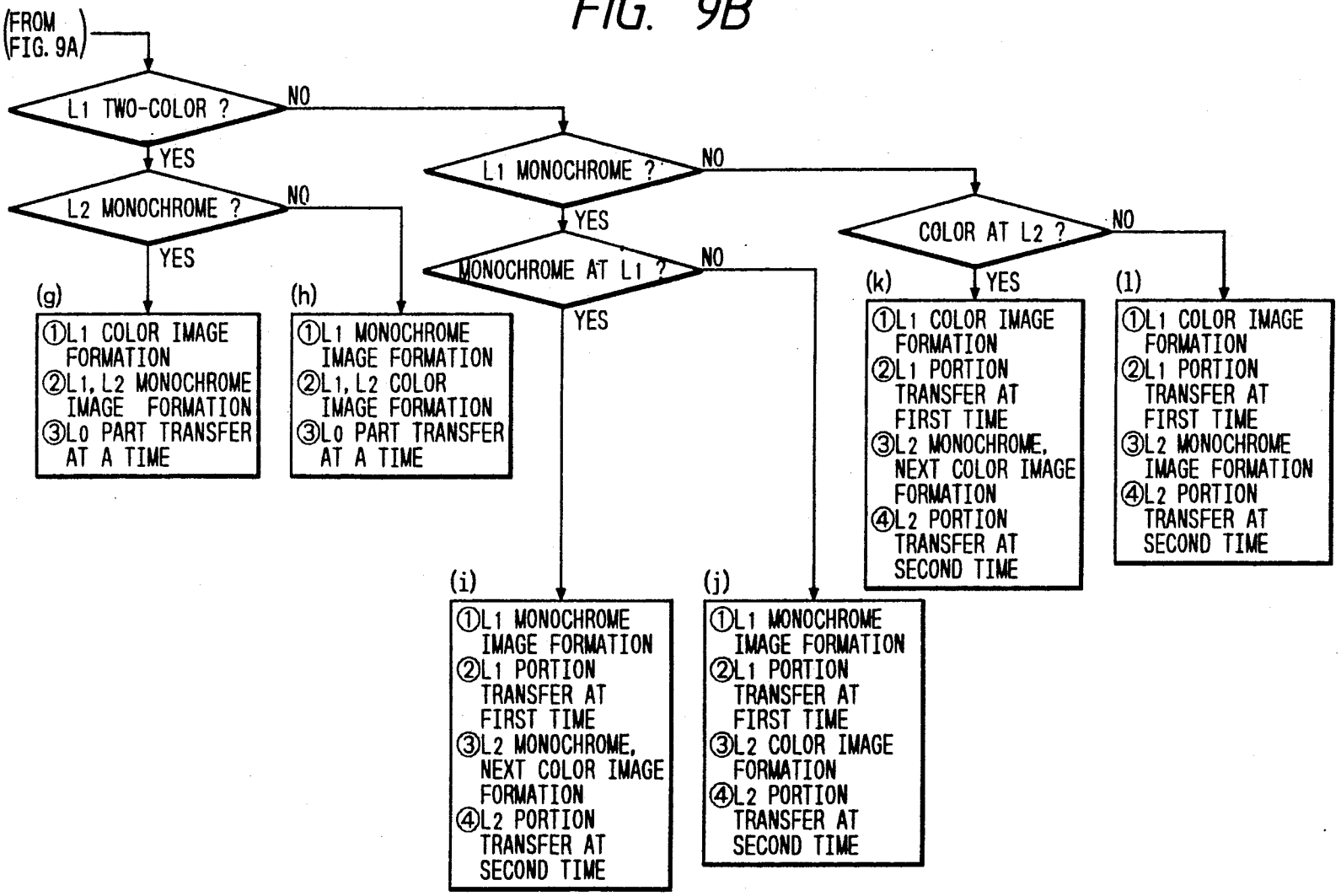

FIG. 9A and FIG. 9B show flow charts in cases of the recording of the image information of FIG. 8A and FIG. 8B. The steps (a)-(f) of FIG. 9A correspond to the steps (a)-(f) of FIG. 8A, and the steps (g)-(l) of FIG. 9B correspond to the steps (g)-(l) of FIG. 8B, respectively.

When the image information is A4 size, as shown from the step (a) to the step (c), the image information having A4 size can be recorded at one time by the provision of the length $L_o$ in the peripheral length direction of the photosensitive drum 1. When the image information is A3 size, as shown in the steps (d) -(l), the length $L_o$ of the photosensitive drum 1 is divided into the area $L_1$ and the area $L_2$, and the image information having A3 size can be recorded on the divided area $L_1$ and the divided area $L_2$.

First of all, in the item (1) the size of the image information is determined. The image information is branched according to the paper size signal 111 from the cassette 5. Next, in the item (2), the image information is determined as single color image information or two-color image information. Further, when the image information is A3 size, in the item (3) it is determined in which part of the two divided areas the image information exists, and the respective image information is branched individually.

Next, the process for recording the image information shown in FIG. 8A and FIG. 8B will be explained. When the image information is a single color, regardless of the size of the image information, the image formation and the transfer process are carried through only one time.

For example, the step (a) of FIG. 8A shows only the monochrome image information having A4 size, at the step (1) the monochrome toner image having the length $L_o$ is formed in the peripheral length direction of the photosensitive drum 1, and at the step (2) the toner image is transferred to the recording paper 6 in a one time transfer process.

The step (f) of FIG. 8A shows that when monochrome image information having A3 size and color image information having A3 size exist, then the electro-photography printing process follows the time chart of FIG. 6.

At the step (f)(1) the monochrome toner image information for the area $L_1$ of the recording paper 6 is formed on the photosensitive drum 1, and toner image is formed by overlapping. At the step (2), the overlapped toner image is transferred onto the area $L_1$ of the recording paper 6. Further, at step (3), the overlapped toner image comprising the monochrome toner image and the color toner image is formed for the area $L_2$ of the recording paper 6. At the step (4) the second time transfer for transferring this onto the area $L_2$ of the recording paper 6 is carried out.

The step (g) and the step (h) of FIG. 8B show a case in which the area $L_1$ of the recording paper 6 of A3 size is provided with two-color image information, and the area $L_2$ of the recording paper 6 is provided with single color image information. In this case, when the order for the image information of area $L_2$, is selected, corresponding the image can be formed in a one time transfer process.

In the step (g) of FIG. 8B, at the step (1) the color toner image in the area $L_1$ of the recording paper 6 is formed on the photosensitive drum 1. At the step (2) the monochrome toner image is formed from the area $L_1$ to the area $L_2$ of the recording paper 6, and at the step (3) by transferring, the two-color information having A3 size can be formed on the recording paper 6 according to a one time transfer process.

From the step (i) to the step (1) of FIG. 8B, the image information can be formed on the area $L_1$ and the area $L_2$ of the recording paper 6 according to two-time transfer processes.

In this embodiment according to the present invention, the example of the photosensitive drum 1 having an outer diameter of 114.6 mm (peripheral length of 360 mm) is explained. However, the size of the photosensitive drum 1 is not limited necessarily to this embodiment.

As another example, utilizing A4 size recording paper (297 mm in length, 210 mm in width) which is used generally and commonly, to record and reproduce the color image information in a one time transfer process, a photosensitive drum having the following size may be employed in the color laser beam printer.

Namely, for example, the length of the photosensitive drum 1 is the length of the recording paper 6 (297 mm) plus a length $\alpha$ of 33 mm. In other words, the length of the photosensitive drum 1 is 330 mm (outer diameter of 105 mm).

The value of $\alpha$ may be determined by considering the movement distance of the photosensitive drum 1 and the width of the charger 2 etc. The above stated movement distance of the photosensitive drum 1 is the distance moved after the transfer unit 10 is commanded to move in the upward direction and before the transfer belt 11 contacts the photosensitive drum 1.

Another example for the divided areas of the color image information will be explained. In the embodiment shown in FIG. 4, the color image information having a length of $L_o$ is recorded and reproduced in two areas ($L_1+L_2$) on a sheet of recording paper 6.

However, it is necessary to record and reproduce color image information having a length of $L_o$ longer than the length of the recording paper 6. In such a case, the length of $L_o$ of the color image information may be divided into N areas ($N \geqq 3$) on one recording paper 6 as shown in FIG. 10. Then the toner image is transferred onto the N areas of the recording paper 6.

In this embodiment of the present invention, the number of areas N into which the length $L_o$ of the color image information is divided is determined at the control circuit apparatus 100 in accordance with the peripheral length $L_k$ of the photosensitive drum 1 and the length $L_o$ of the color image information. In this case, the proper recording paper 6 is selected from the most suitable cassette 5.

Further, the above stated value of N may be set through an input by a key in accordance with the combination of the image information and the recording paper 6, and further the control program can be designated in the control circuit apparatus 100.

In this case, the judgment flow-charts of the image information of FIG. 9A and FIG. 9B are modified so as to carry out N times the formation of the toner image and the practice for the transfer process, etc. Besides, as the capacity of the description memory 110 of FIG. 8, a following specification for the description memory 110 is used, such a specification for the description memory 110 can correspond fully with respect to the size of the color information.

In FIG. 4, the color image information is recorded and reproduced on the recording paper 6 by dividing the length $L_p$ of the recording paper 6 into two areas comprised of the area $L_1$ and the area $L_2$. Accordingly, a recording paper 6 can be selected having a length of $L_p$ corresponding to the length of the image information to be recorded and reproduced.

In general, let the length in the peripheral direction of the photosensitive drum 1 of the image information be $L_o$, let the number of areas for dividing the peripheral direction length of the image information $L_o$ be N, and let the length from the transfer point t to the resist roller 8 be $L_{tr}$. Then the following relation exists.

$$L_o > N \times L_{tr}.$$

Further, with respect to the peripheral length $L_k$ of the photosensitive drum 1, the following relation exists.

$$L_o > L_{tr+\alpha}.$$

For example, when the recording paper 6 is A3 size having the length L of 420 mm and the number of divided areas N is 3, under the consideration of the extra transporting of the recording paper 6 and the length for returning back of the recording paper 6, then the length $L_{tr}$ from the transfer point t to the resist roller 8 and the peripheral length $L_k$ of the photosensitive drum 1 can be as follows.

$L_{tr}$ = 100 to 120 mm $L_k$ = 130 to 150 mm (outer diameter = 41 to 48 mm)

Besides, it is indispensable to provide the plural development apparatus 4, the cleaner 21, the eraser 20, the charger 2, the exposure apparatus 3 and the transfer unit 10 surrounding the photosensitive drum 1. Thereby, the outer diameter of the photosensitive drum 1 may be set as follows. Namely, from the aspect of the design for the color laser beam printer, the value of the outer diameter of the photosensitive drum 1 is selected to be more than 2 to 3 times greater than the above stated values.

Further, the recording paper 6 has a blank portion at the front tip end and a blank portion at the rear end. In these blank portions of the recording paper 6 recording is not carried out, and the blank portion has a length of 2 to 3 mm. The length $L_p$ of the recording paper 6 can be set longer than the length $L_o$ in the peripheral length direction of the image information by the length of this blank portion.

In addition to the above examples, in the transfer portion of this embodiment according to the present invention the transfer unit 10 including a transfer belt 11 is used, however, it is not limited only thereto.

For example, as the transfer portion in the color laser beam printer, there may be used a corona transfer system combining the transfer means with the discharger for separating the recording paper, the system employing the transportation belt from the paper separation portion to the fixing apparatus and the roller transfer system employing the conductive roller to the transfer apparatus etc.

Further, in this embodiment of the present invention, the development apparatus **4*b* for monochrome is operated prior to the development apparatus 4*c* for color; however, the latter can be operated prior to the former. However, with respect to the various image information shown in FIG. 8A and FIG. 8B, the development apparatus 4*c* for color may be operated prior to the development apparatus 4*b*** for monochrome. Accordingly, the transfer process is carried out with the minimum number of steps.

Further, using FIG. 4, another example will be explained, namely the length $L_p$ of the recording paper 6 is divided into area $L_1$ and area $L_2$, and the color information is recorded on area $L_1$ and area $L_2$ of the recording paper 6, respectively.

However when area $L_1$ includes only a single color image or area $L_2$ includes only a single color image, it is possible to perform the exposure process and the development process only for the single color.

As an example for the above structure, in a case in which the color information exists only in area $L_1$ of the recording paper 6 in FIG. 4, by controlling at first to form the toner image for color on the photosensitive drum 1 and next to form the monochrome toner image on the photosensitive drum 1, accordingly the overlapped two-color toner image can be reproduced on all area $L_p$ or the full length of the recording paper 6 with a one-time transfer process.

In this case, it is unnecessary to perform the return-back of the recording paper 6 and the transfer process. Therefore performing the recording on the recording paper 6 is done in a short time.

Another example will be explained referring to the item (g) of FIG. 8B. When the two-color image information exists in only the area $L_1$ of the recording paper 6, the following control is carried out. Namely, at first the toner image for color is formed on the photosensitive drum 1 and next the toner image for monochrome is formed on the photosensitive drum 1. Thereby the overlapped two-color toner image can be reproduced on all the area $L_p$ or full length of the recording paper 6 through a one-time transfer process.

Accordingly, in this latter case, it is unnecessary to carry out the return-back of the recording paper 6 and a plural times transfer processes, and the recording on the recording paper 6 is carried out in a short time.

As shown in the item (b) of FIG. 10, when the two-color image information exists only in the first divided area $L_1$ of the recording paper 6 and the single color image information exists in all other areas of the recording paper 6, from the area $L_2$ to the area $L_n$, the transfer process can be carried out at one time. With respect to the combination of the various image information, they can be controlled similarly through the processes shown in FIG. 10.

By using a host computer, it is possible to control the apparatus to operate efficiently with any kind of control for the above stated various processes in a short time.

In this embodiment of the present invention, the color laser beam printer comprising the photosensitive drum and the development apparatus for n colors having plural development units is employed as the color image electro-photography apparatus.

However, another type color laser beam printer can be employed as the color image electro-photography apparatus so as to attain the present invention. For example, a color laser beam printer comprising a photosensitive belt member, an intermediate transfer body and a development apparatus. Such a photosensitive belt member works as a toner image holding body for transporting a toner image to the intermediate transfer body. The development apparatus having plural development units is arranged surrounding this photosensitive belt member. The intermediate transfer body is formed by an intermediate transfer drum.

After the photosensitive belt member is charged uniformly by a charger, an electric-static latent image is formed on the photosensitive belt member by exposing it by a laser beam light. The electric-static latent image is developed through the development apparatus. The developed toner image is transported in accordance with the movement of the photosensitive belt member. The toner image is transferred to one side of the intermediate transfer drum at a transfer portion in which the toner image contacts the intermediate transfer drum.

The photosensitive belt member which has passed through the transfer portion is discharged by an eraser apparatus, and residual toner is removed by a belt-type cleaning apparatus. The photosensitive belt member is charged uniformly again by the charger. The toner image of n colors is formed by overlapping each color using the respective development unit and is transferred to the intermediate transfer drum.

In the above stated color laser beam printer as the color image electro-photography apparatus, the toner supporting body comprises the photosensitive belt member and the intermediate transfer drum. As the effective length for the formation of an overlapped toner image of n colors, it utilizes the length in the peripheral direction on the intermediate transfer drum of the color image information.

In this kind of color laser beam printer, the length in the peripheral direction on the intermediate transfer drum of the color image information corresponds to the length ($L_o$) in the peripheral direction on the photosensitive drum of the color image information of the former stated embodiment of the present invention.

We claim:

1. An electro-photography apparatus for forming on a recording medium a recorded image corresponding to image information, said electro-photography apparatus comprising toner supporting means; charge means for forming an electrical charge on said toner supporting means; exposure means responsive to image information for exposing said electrically charged toner supporting means to form on said toner supporting means a latent electrostatic image corresponding to the image information; developing means for providing toner to said toner supporting means to develop the latent electrostatic image into a toner image on said toner supporting means; recording medium transporting means for transporting a recording medium into contact with the toner image on said toner supporting means; transfer means for transferring the toner image onto the recording medium; fixing means for fixing the transferred toner image on the recording medium; and control means for controlling said electro-photography apparatus, said control means including:

dividing means responsive to image information indicating an image having a length greater than the length of said toner supporting means for dividing the image into N image areas, each image area having a length equal to or less than the length of the toner supporting means, where N is an integer and $N \geqq 2$;

first activating means for activating said toner supporting means, said charge means, said exposure means, and said developing means to form on said toner supporting means a toner image of one of the N image areas;

second activating means for activating said toner supporting means, said recording medium transporting means, and said transfer means to transfer the toner image onto the recording medium in a recording medium area corresponding to the one of the N image areas;

third activating means for causing N repeated operations of said first and second activating means to form on said toner supporting means a toner image of each of the N image areas in sequence and to transfer each toner image in sequence onto the recording medium in a recording medium area corresponding to the respective one of the N image areas; and fourth activating means for activating said recording medium transporting means and said fixing means to fix the toner image of each of the N image areas, forming on the recording medium an image corresponding to the image information.

2. An apparatus as claimed in claim 1, wherein said third activating means includes means operative during the first (N−1) of the N repeated operations of said first and second activating means for causing said second activating means to activate said recording medium transporting means to transport the recording medium in a first direction a distance ($L_a$+r) with the recording medium in contact with said toner supporting means, means for separating the recording medium from said toner supporting means, means for activating said recording medium transporting means to transport the recording medium in a second direction opposite the first direction a distance r with the recording medium out of contact with said toner supporting means, and means for returning the recording medium into contact with said toner supporting means.

3. A color electro-photography apparatus for forming on a recording medium a recorded color image having n colors corresponding to color image information, where n is an integer and n≧2, said electro-photography apparatus comprising a photosensitive body; charge means for forming an electrical charge on said photosensitive body; exposure means responsive to image information for exposing said electrically charged photosensitive body to form on said photosensitive body a latent electrostatic image corresponding to the image information; a set of n developing means for selectively providing n colors of toner to said photosensitive body to develop the latent electrostatic image into a color toner image on said photosensitive body; recording medium transporting means for transporting a recording medium into contact with the color toner image on said photosensitive body; a transfer means for transferring the color toner image onto the recording medium; fixing means for fixing the transferred color toner image on the recording medium; and control means for controlling said electro-photography apparatus, said control means including:

dividing means responsive to color image information indicating a color image having a length $L_o$ greater than the length $L_k$ of said photosensitive body for dividing the color image into N image areas, each image area having a length equal to or less than the length of the photosensitive body, where N is an integer, and N≧2;

first activating means for activating said photosensitive body, said charge means, said exposure means, and one of said n developing means to form on said photosensitive body a toner image of one of the N image areas in one of the n color toners;

second activating means for causing repeated operation of said first activating means to form on said photosensitive body a color toner image of said one of the N image areas;

third activating means for activating said photosensitive body, said recording medium transporting means, and said transfer means to transfer the color toner image onto the recording medium in a recording medium area corresponding to the one of the N image areas;

fourth activating means for causing N repeated operations of said second, and third activating means to form on said photosensitive body a color toner image of each of the N image areas in sequence and to transfer each color toner image in sequence onto the recording medium in a recording medium area corresponding to the respective one of the N image areas; and fifth activating means for activating said recording medium transporting means and said fixing means to fix the color toner image of each of the N image areas, forming on the recording medium a color image corresponding to the color image information.

4. An apparatus as claimed in claim 3, wherein said fourth activating means includes means operative during the first (N−1) of the N repeated operations of said first, second, and third activating means for causing said third activating means to activate said recording medium transporting means to transport the recording medium in a first direction a distance ($L_a$+r) with the recording medium in contact with said photosensitive body, means for separating the recording medium from said photosensitive body, means for activating said recording medium transporting means to transport the recording medium in a second direction opposite the first direction a distance r with the recording medium out of contact with said photosensitive body, and means for returning the recording medium into contact with said photosensitive body.

5. An apparatus as claimed in claim 4, wherein the recording medium has a length $L_m$ and said fixing means is spaced from said transfer means by a distance greater than $L_m$ so that during said first (N−1) of the N repeated operations of said first, second, and first activating means the recording medium does not contact said fixing means.

6. An apparatus as claimed in claim 3, wherein said recording medium transporting means includes resist means for aligning the recording medium prior to said transfer means transferring the color toner image onto the recording medium, said resist means being spaced from said transfer means by a distance $L_{tr}$, where $L_o > N.L_{tr}$.

7. An apparatus as claimed in claim 6, wherein $L_k > L_{tr}$.

8. A color electro-photography apparatus for forming on a recording medium a recorded color image having n colors corresponding to color image information, where n is an integer and n≧2, said electro-photography apparatus comprising an photosensitive body; charge means for forming an electrical charge on said photosensitive body; exposure means responsive to image information for exposing said electrically charged photosensitive body to form on photosensitive body a latent electrostatic image corresponding to the image information; a set of n developing means for selectively providing n colors of toner to said photosensitive body to develop the latent electrostatic image into a color toner image on said photosensitive body; recording medium transporting means for transporting a recording medium into contact with the color toner image on said photosensitive body; transfer means for transferring the color toner image onto the recording medium; fixing means for fixing the transferred color toner image on the recording medium; and control means for controlling said electro-photography apparatus, said control means including:

dividing means responsive to color image information indicating a color image having a length greater than the length of said photosensitive body for dividing the color image into N image areas, each image area having a length equal to or less than the length of the photosensitive body, where N is an integer, and $N \geqq 2$, said dividing means further responsive to color image information indicating a color image having a length equal to or less than the length of said photosensitive body for retaining the color image within a single image area so that $N=1$;

first activating means for activating said photosensitive body, said charge means, said exposure means, and one of said n developing means to form on said photosensitive body a toner image of one of the N image areas in one of the n color toners;

second activating means for causing repeated operation of said first activating means to form on said photosensitive body a color toner image of said one of the N image areas;

third activating means for activating said photosensitive body, said recording medium transporting means, and said transfer means to transfer the color toner image onto the recording medium in a recording medium area corresponding to the one of the N image areas;

fourth activating means for causing N operations of said second, and third activating means to form a color toner image of each of the N image areas in sequence on said photosensitive body and to transfer each color toner image in sequence onto the recording medium in a recording medium area corresponding to the respective one of the N image areas; and fifth activating means for activating said recording medium transporting means and said fixing means to fix the color toner image of each of the N image areas, forming a color image on the recording medium corresponding to the color image information.

9. A color electro-photography apparatus for forming on a recording medium a recorded color image having n colors corresponding to color image information, where n is an integer and $n \geqq 2$, said electro-photography apparatus comprising photosensitive body; charge means for forming an electrical charge on said photosensitive body; exposure means responsive to image information for exposing said electrically charged photosensitive body to form on photosensitive body a latent electrostatic image corresponding to the image information; a set of n developing means for selectively providing n colors of toner to said photosensitive body to develop the latent electrostatic image into a color toner image on said photosensitive body; recording medium transporting means for transporting a recording medium into contact with the color toner image on said photosensitive body; transfer means for transferring the color toner image onto the recording medium; fixing means for fixing the transferred color toner image on the recording medium; and control means for controlling said electro-photography apparatus, said control means including:

dividing means responsive to color image information indicating a color image having a length $L_o$ greater than the length $L_k$ of said photosensitive body for dividing the color image into N image areas, each image area having a length equal to or less than the length of the photosensitive body, where N is an integer and $N \geqq 2$;

first activating means for activating said photosensitive body, said charge means, said exposure means, and one of said n developing means to form on said photosensitive body a toner image of one of the N image areas in one of the n color toners;

second activating means, responsive to color image information indicating that said one of the N image areas include p colors, for causing p repeated operations of said first activating means, where p is an integer and $p<n$, to form on said photosensitive body a color toner image of said one of the N image areas;

third activating means for activating said photosensitive body, said recording medium transporting means, and said transfer means to transfer the color toner image onto the recording medium in a recording medium area corresponding to the one of the N image areas;

fourth activating means for causing N repeated operations of said second, and third activating means to form on said photosensitive body a color toner image of each of the N image areas in sequence and to transfer each color toner image in sequence onto the recording medium in a recording medium area corresponding to the respective one of the N image areas; and fifth activating means for activating said recording medium transporting means and said fixing means to fix the color toner image of each of the N image areas, forming on the recording medium a color image corresponding to the color image information.

10. Apparatus as claimed in claim 9, wherein when $n=N=2$ and $p=1$, said dividing means resets N so that $N=1$.

* * * * *